US008793952B2

(12) United States Patent
Olang

(10) Patent No.: US 8,793,952 B2
(45) Date of Patent: Aug. 5, 2014

(54) APPARATUS AND METHODS FOR APPLICATION OF FOAM AND FOAM/LOOSEFILL INSULATION SYSTEMS

(76) Inventor: Fatemeh Nassreen Olang, Granville, OH (US)

( * ) Notice: Subject to any disclaimer, the term of this patent is extended or adjusted under 35 U.S.C. 154(b) by 0 days.

(21) Appl. No.: 12/952,292

(22) Filed: Nov. 23, 2010

(65) Prior Publication Data

US 2011/0138724 A1 Jun. 16, 2011

Related U.S. Application Data

(60) Provisional application No. 61/286,950, filed on Dec. 16, 2009.

(51) Int. Cl.
*E04B 1/74* (2006.01)

(52) U.S. Cl.
USPC .... 52/309.4; 52/404.1; 52/742.13; 428/309.9

(58) Field of Classification Search
USPC ..... 52/309.4, 794.1, 309.5, 404.1, 407.3, 52/742.1, 742.13; 428/71, 304.4, 316.6, 428/309.9
See application file for complete search history.

(56) References Cited

U.S. PATENT DOCUMENTS 2,179,678 A * 11/1939 Wenzel ..... 52/407.3
2,780,090 A * 2/1957 Rasmussen ..... 52/309.7
3,619,437 A * 11/1971 McDonald, Jr. ..... 264/46.6
3,722,171 A 3/1973 Godley
3,785,913 A * 1/1974 Hallamore ..... 428/71
3,861,993 A * 1/1975 Guthrie ..... 428/212
3,872,199 A 3/1975 Ottinger
3,929,948 A * 12/1975 Welch et al. ..... 264/45.5
3,933,514 A * 1/1976 Banks et al. ..... 106/602
4,073,839 A * 2/1978 Burkholder et al. ..... 264/45.1
4,103,464 A * 8/1978 Clifft et al. ..... 52/127.4
4,116,893 A * 9/1978 Flanagan ..... 521/137
4,190,697 A * 2/1980 Ahrens ..... 428/309.9
4,337,318 A * 6/1982 Doyle ..... 521/80
4,419,256 A 12/1983 Loomis
4,425,396 A * 1/1984 Hartman ..... 428/220
4,452,829 A * 6/1984 Smith ..... 427/209
4,471,591 A * 9/1984 Jamison ..... 52/309.9
4,494,343 A * 1/1985 Berry et al. ..... 52/309.11
4,661,302 A * 4/1987 Park ..... 264/53
4,726,086 A * 2/1988 McEvoy ..... 5/653
4,768,710 A 9/1988 Sperber
4,795,590 A * 1/1989 Kent et al. ..... 588/249

(Continued)

FOREIGN PATENT DOCUMENTS

CA 2153293 1/1997
EP 1350905 A1 10/2003

OTHER PUBLICATIONS

Collins English Dictionary definition of "chemical bond", available at <http://www.collinsdictionary.com>.*

*Primary Examiner* — Brent W Herring
(74) *Attorney, Agent, or Firm* — Fraser Clemens Martin & Miller LLC; Charles F. Charpie

(57) ABSTRACT

An insulated cavity is provided. The insulated cavity includes a layer of foam material positioned over cracks and around penetrations occurring in portions of the cavity. A layer of insulative material is positioned in contact with the layer of foam material. The layer of insulative material is a mixture of foam material and loosefill insulation material.

20 Claims, 5 Drawing Sheets

(56) References Cited

U.S. PATENT DOCUMENTS

| | | | | | |
|---|---|---|---|---|---|
| 4,804,506 | A | * | 2/1989 | Okamoto et al. | 264/45.1 |
| 5,060,291 | A | * | 10/1991 | Albertelli | 428/306.6 |
| 5,091,436 | A | * | 2/1992 | Frisch et al. | 521/137 |
| 5,106,547 | A | * | 4/1992 | Beck et al. | 264/46.4 |
| 5,131,590 | A | * | 7/1992 | Sperber | 239/8 |
| 5,192,598 | A | * | 3/1993 | Forte et al. | 428/71 |
| 5,287,674 | A | * | 2/1994 | Sperber | 52/742.13 |
| 5,373,026 | A | * | 12/1994 | Bartz et al. | 521/82 |
| 5,389,167 | A | * | 2/1995 | Sperber | 156/71 |
| 5,425,908 | A | * | 6/1995 | Merser | 264/46.4 |
| 5,447,389 | A | * | 9/1995 | Olson | 405/129.7 |
| 5,489,407 | A | * | 2/1996 | Suh et al. | 264/50 |
| 5,633,063 | A | * | 5/1997 | Lause et al. | 428/71 |
| 5,641,368 | A | * | 6/1997 | Romes et al. | 156/71 |
| 5,645,928 | A | * | 7/1997 | Matsumoto et al. | 428/304.4 |
| 5,655,350 | A | * | 8/1997 | Patton | 52/742.13 |
| 5,688,832 | A | * | 11/1997 | Paquet et al. | 521/79 |
| 5,753,359 | A | * | 5/1998 | Dyer et al. | 428/315.5 |
| 5,869,171 | A | * | 2/1999 | Shiveley et al. | 428/304.4 |
| 5,908,501 | A | * | 6/1999 | Pucillo | 106/634 |
| 5,921,055 | A | * | 7/1999 | Romes et al. | 52/742.13 |
| 6,047,518 | A | * | 4/2000 | Lytle | 52/742.13 |
| 6,096,416 | A | * | 8/2000 | Altenberg | 428/317.7 |
| 6,228,476 | B1 | * | 5/2001 | Bogrett et al. | 428/306.6 |
| 6,262,164 | B1 | * | 7/2001 | Church et al. | 524/494 |
| 6,409,817 | B1 | * | 6/2002 | Stephens | 106/601 |
| 6,414,044 | B2 | * | 7/2002 | Taylor | 521/65 |
| 6,584,749 | B2 | | 7/2003 | Sperber | |
| 7,083,693 | B2 | * | 8/2006 | Chen et al. | 156/79 |
| 7,368,150 | B2 | * | 5/2008 | Pritchett | 427/412 |
| 7,797,950 | B2 | * | 9/2010 | Brower et al. | 62/55.5 |
| 7,866,105 | B2 | * | 1/2011 | Babbitt et al. | 52/404.1 |
| 8,209,930 | B2 | * | 7/2012 | Babbitt et al. | 52/404.1 |
| 2003/0031854 | A1 | * | 2/2003 | Kajander et al. | 428/304.4 |
| 2003/0032350 | A1 | * | 2/2003 | Kajander et al. | 442/76 |
| 2004/0256395 | A1 | * | 12/2004 | Lak et al. | 220/560.15 |
| 2005/0281979 | A1 | * | 12/2005 | Toas et al. | 428/113 |
| 2006/0096205 | A1 | * | 5/2006 | Griffin et al. | 52/309.4 |
| 2006/0272280 | A1 | | 12/2006 | Romes et al. | |
| 2007/0122584 | A1 | * | 5/2007 | Song et al. | 428/71 |
| 2007/0234649 | A1 | | 10/2007 | Near et al. | |
| 2008/0160203 | A1 | | 7/2008 | O'Leary et al. | |
| 2008/0217422 | A1 | | 9/2008 | Near | |
| 2009/0004459 | A1 | * | 1/2009 | Kipp et al. | 428/318.4 |
| 2009/0107068 | A1 | | 4/2009 | Fay et al. | |
| 2010/0065206 | A1 | * | 3/2010 | Romes | 156/293 |
| 2010/0087562 | A1 | * | 4/2010 | Diloreto et al. | 521/170 |
| 2010/0107550 | A1 | * | 5/2010 | Toas et al. | 52/742.12 |
| 2010/0297424 | A1 | * | 11/2010 | Romes et al. | 428/307.7 |

* cited by examiner

APPARATUS AND METHODS FOR APPLICATION OF FOAM AND FOAM/LOOSEFILL INSULATION SYSTEMS

RELATED APPLICATIONS

This application claims the benefit of pending U.S. Provisional Patent Application No. 61/286,950, filed Dec. 16, 2009, the disclosure of which is incorporated herein by reference.

BACKGROUND

Various insulative products or combinations of insulative products can be used to insulate buildings. Some of the insulative products include spray foams, board insulation, loosefill insulation, and batts of fibrous insulation.

Spray foam insulation can include materials that are mixed at the building site and applied with a sprayer. The sprayer can be configured to introduce the spray foam insulation into joints, cavities, and penetrations of the building ceilings, floors and walls. After setting, the spray foam insulation can be effective in reducing air infiltration into the building and also effective in providing insulative properties to the building. Spray foam insulation can be used in combination with subsequently installed insulative products such as loosefill insulation and batts of fibrous insulation.

In contrast to spray foam insulation, loosefill insulation includes a multiplicity of discrete, individual tufts, cubes, flakes or nodules. Loosefill insulation can be applied to buildings by blowing the loosefill insulation into insulation cavities, such as sidewall cavities or an attic of a building. Loosefill insulation can be made from glass fibers, although other mineral fibers, organic fibers, and cellulose fibers can be used. The distribution of the loosefill insulation into an insulation cavity typically uses a blowing insulation distribution machine that conditions the loosefill insulation and feeds the conditioned loosefill insulation pneumatically through a distribution hose.

It would be advantageous if systems using combinations of spray foam insulation and loosefill insulation could be improved.

SUMMARY

In accordance with embodiments of this invention there is provided an insulated cavity including a layer of foam material positioned over cracks and around penetrations occurring in portions of the cavity. A layer of insulative material is positioned in contact with the layer of foam material. The layer of insulative material is a mixture of foam material and loosefill insulation material.

In accordance with embodiments of this invention there are also provided an insulated cavity including a layer of insulative material positioned over cracks and around penetrations occurring in portions of the cavity. The layer of insulative material is a mixture of foam material and loosefill insulation material.

In accordance with embodiments of this invention there is also provided an insulated cavity including a layer of foam material positioned over cracks and around penetrations occurring in portions of the cavity. A layer of insulative material is positioned in contact with the layer of foam material. The layer of insulative material is a mixture of foam material and loosefill insulation material. The layer of foam material and the layer of insulative material maintain their position within the cavity without additional support.

In accordance with embodiments of this invention there is also provided apparatus configured for insulating an insulation cavity within a building. The apparatus includes a spray foam device configured for mixing foam material and a blowing insulation machine configured for conditioning loosefill insulation material. The apparatus is configured to selectively deliver a layer of foam material to the insulation cavity and a layer of insulative material to the insulation cavity. The layer of insulative material has a mixture of foam material and conditioned loosefill insulation material.

In accordance with embodiments of this invention there is also provided a method of insulating a cavity within a building. The method includes the steps of applying a layer of foam material into the cavity, applying a layer of insulative material into the cavity, the layer of insulative material being positioned in contact with the layer of foam material, the layer of insulative material being a mixture of foam material and loosefill insulation material, the layer of insulative material applied before the layer of foam material cures, allowing the layer of foam material and the layer of insulative material to cure.

Various advantages of this invention will become apparent to those skilled in the art from the following detailed description of the invention, when read in light of the accompanying drawings.

DETAILED DESCRIPTION OF THE INVENTION

Figure 1:
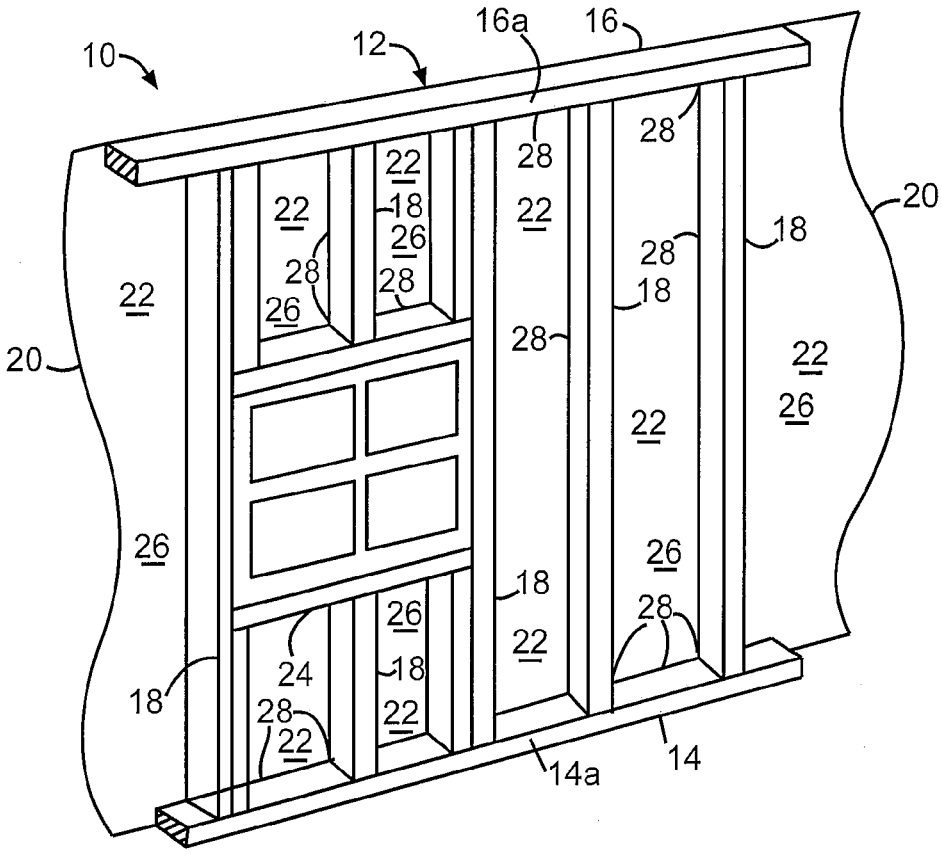
FIG. 1 is a schematic perspective view of a portion of a building structure illustrating insulation cavities.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

The description and figures disclose apparatus and methods for application of foam material and combinations of foam material and loosefill insulation into insulation cavities of a building. Generally, the apparatus is configured to apply a layer of air sealant foam material over the cracks and penetrations of insulation cavities followed quickly by an insulative layer of material having a combination of foam material and loosefill insulation, thereby substantially filling the remainder of the insulation cavity.

The term "insulation cavity" as used herein, is defined to mean any space within the building within which insulation is desired, including the non-limiting examples of a building attic or sidewalls. The term "cracks", as used herein, is defined to mean spaces or openings through which exterior air can enter the building enclosure. The term "penetrations", as used herein, is defined to mean holes or openings passing through the building enclosure in which ducts, pipes, wires, structural elements, and windows are run between the building interior and the building exterior. The term "building enclosure", as used herein, is defined to mean the system or assembly of components that provides environmental separation between an interior conditioned space and an exterior environment.

Referring now to FIG. 1, a portion of a building is illustrated generally at 10. The building 10 includes a sidewall 12. The sidewall 12 is configured to define interior space within the building and to support additional structural components. The sidewall 12 is formed from a bottom plate 14, a top plate 16 and a plurality of framing members 18 extending therebetween. The bottom plate 14 and the top plate 16 are substantially horizontal members configured to provide surfaces to which additional framing members are attached. In the illustrated embodiment, the bottom plate 14, top plate 16 and framing members 18 are made of wood. In other embodiments, the bottom plate 14, top plate 16 and framing members 18 can be made of other desired materials, including the non-limiting example of steel. The bottom plate 14, top plate 16 and framing members 18 can have any desired dimensions. The bottom plate 14, top plate 16 and framing members 18 have interior surfaces 14*a*, 16*a* and 18*a*, respectively.

Referring again to FIG. 1, the sidewall 12 is covered by exterior sheathing 20 attached to an exterior side of the bottom plate 14, top plate 16 and framing members 18. The exterior sheathing 20 is configured to provide rigidity to the sidewall 12 and also configured to provide a surface for an exterior wall covering (not shown). In the illustrated embodiment, the exterior sheathing 20 is made of oriented strand board (OSB). In other embodiments, the exterior sheathing 20 can be made of other materials, such as for example plywood, waferboard, rigid foam or fiberboard, sufficient to provide rigidity to the sidewall 12 and to provide a surface for an exterior wall covering. As shown in FIG. 1, the exterior sheathing 20 has an interior surface 22. Optionally, the sidewall 12 can include building fixtures, including the non-limiting examples of a window 24 or door (not shown).

Insulation cavities 26 are formed in the spaces between the plurality of framing members 18 and the interior surface 22 of the exterior sheathing 20. As illustrated in FIG. 1, the insulation cavities 26 can extend from the bottom plate 14 to the top plate 16. Alternatively, the insulation cavities 26 can extend from the bottom plate 14 or the top plate 16 to a building fixture, such as the window 24. While the insulation cavities 26 illustrated in FIG. 1 are shown as being located in the sidewall 12 of the building 10, it should be appreciated that other insulation cavities can occur in other locations of the building 10, such as the non-limiting example of an attic space. The insulation cavities 26 can have any size, shape or configuration and can be formed between any building components or members.

Referring again to FIG. 1, the insulation cavities 26 can include cracks 28 formed between structural members of the sidewall 12, such as the non-limiting examples of the exterior sheathing 20, the framing members 18, the bottom plate 14 and the top plate 16. The insulation cavities 26 can also include penetrations (not shown) extending through the sidewall 12. In some instances, the cracks 28 and penetrations can allow exterior air to enter the interior space of the building 10.

Figure 2:
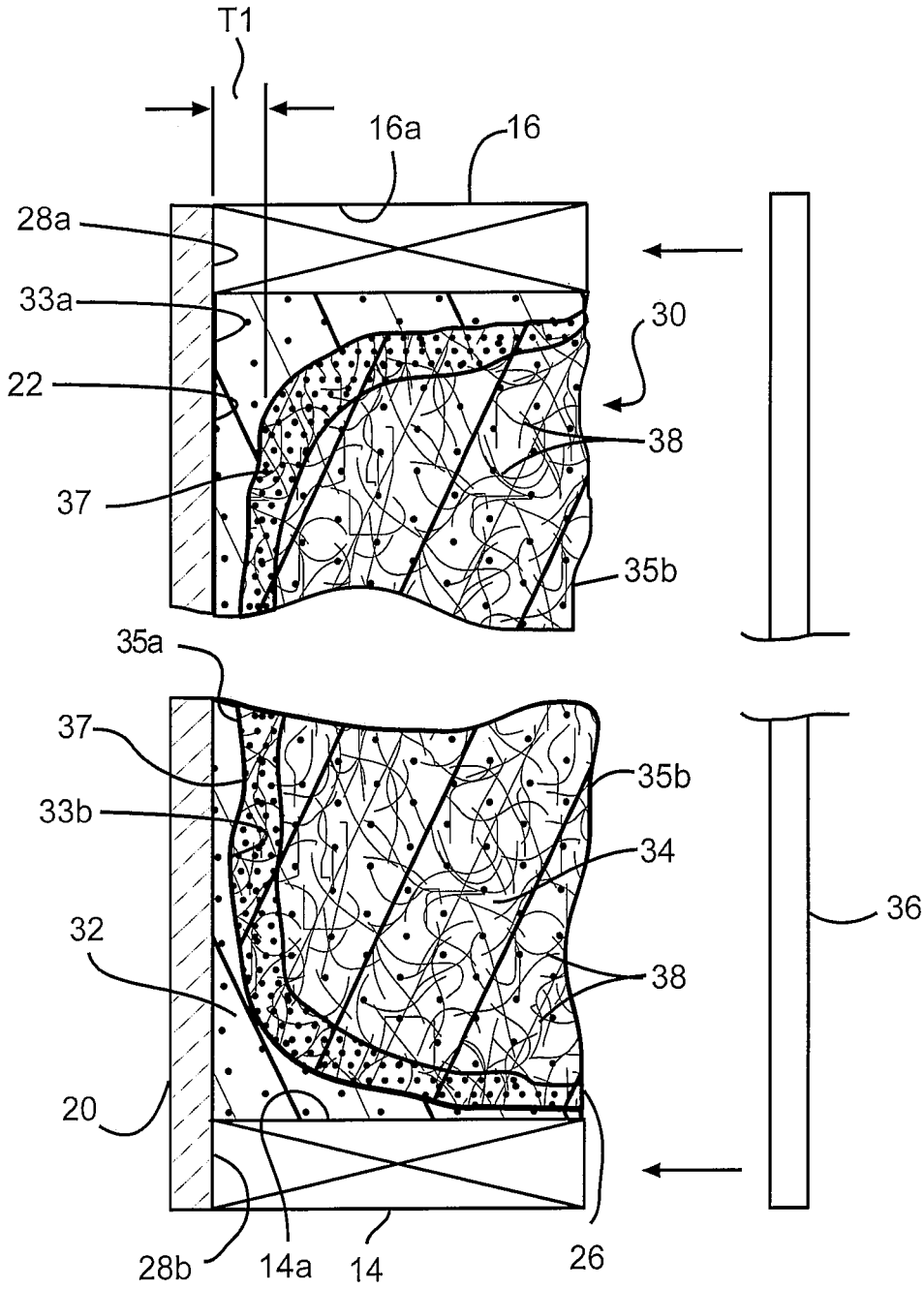
FIG. 2 is a side view, partially in cross-section, of a building cavity filled with a combination of a layer of foam material and a layer of insulative material.

Referring now to FIG. 2, an insulation cavity 26 defined by the bottom plate 14, top plate 16 and interior surface 22 of the exterior sheathing 20 is illustrated. The insulation cavity 26 includes crack 28*a* formed between the exterior sheathing 20 and the top plate 16. The insulation cavity 26 also includes crack 28*b* formed between the exterior sheathing 20 and the bottom plate 14. The insulation cavity 26 has been filled with an insulation system 30. The insulation system 30 includes a layer of foam material 32 and a layer of insulative material 34. The layer of foam material 32 has an exterior surface 33*a* and an interior surface 33*b*. The layer of insulative material 34 has an exterior surface 35*a* and an interior surface 35*b*.

Referring again to FIG. 2, the layer of foam material 32 has been applied in the insulation cavity 26 and is in contact with the interior surfaces forming the insulation cavity 26. In the illustrated embodiment, the layer of foam material 32 has been applied against the interior surface 16*a* of the top plate 16, the interior surface 22 of the exterior sheathing 20 and against the interior surface 14*a* of the bottom plate 14. Accordingly, the layer of foam material 32 covers over the cracks, 28*a* and 28*b*, and substantially prevents exterior air from entering the interior space of the building 10 through the cracks 28*a* and 28*b*. In this manner, the layer of foam material 32 functions to substantially seal the cracks 28*a* and 28*b*.

In the illustrated embodiment, the layer of foam material 32 is a mixture of two components. The foam material is a low expanding material that maintains its flexibility, air sealant properties and adhesion to common building materials over time. Optionally, the foam material can be non-allergenic. One example of the foam material used for the layer of foam material 32 is the ENERGYCOMPLETE™ Spray Foam marketed by Owens Corning headquartered in Toledo, Ohio.

In the embodiment illustrated in FIG. 2, the foam material forming the layer of foam material 32 is a latex-based material that can be described by various physical properties. First, the foam material has a pressure build of less than 0.1 psi as measured by test method AAMA 812. AAMA 812 refers to the pressure development while the foam material cures. Second, the foam material has a water vapor permeance in a range of from about 30 perm to about 50 perm as measured by test method ASTM E 96 (dry cup) or a range of from about 100 per to about 120 perm as measured by ASTM E 96 (wet cup). Test methods under ASTM E 96 measure the water vapor transfer through permeable and semi-permeable materials. Third, the foam material has a maximum dimensional stability of 1.0% linear change at −40° F., ambient RH after two weeks and a maximum 2.0% linear change at 100° F., 97% RH after two weeks, as measured by test method ASTM D 2126. Test method ASTM D 2126 measures dimensional changes of materials exposed to particular environmental conditions, such as temperature and humidity. Fourth, the foam material has a durability of greater than 10 cycles with no cohesive failure or cracking, as measured by test method ASTM C 719. Test method ASTM C 719 evaluates the durability performance of a building sealant in a test configuration when subjected to water immersion, cyclic movement, and temperature change. Fifth, the foam material has a flame spread in a range of from about 8 to about 12 as measured by test method ASTM E 84. Test method ASTM E 84 measures the relative burning behavior of the material by observing the flame spread along a test specimen. Sixth, the foam material has a smoke development in a range of from about 18 to about 22 as also measured by test method ASTM E 84. Finally, the foam material has a leakage rate of less than 0.01 cfm/ft$^2$ at 1.57 psf (75 PA) and 6.24 psf (300 Pa) pressure as measured by test method ASTM E 283. Test method ASTM E 283 determines air leakage characteristics under specified air pressure differences at ambient conditions.

As shown in FIG. 2, the layer of foam material 32 has an average thickness T1. In the illustrated embodiment, the thickness T1 of the layer of foam material 32 is in a range of from about 0.10 inches to about 0.50 inches. In other embodiments, the thickness T1 of the layer of foam material 32 can be less than about 0.10 inches or more than about 0.50 inches.

Referring again to FIG. 2, the layer of insulative material 34 is applied over the layer of foam material 32. In the illustrated embodiment, the layer of insulative material 34 substantially fills the remaining space within the insulation cavity 26. In other embodiments, the layer of insulative material 34 can fill any desired portion of the remaining space within the insulation cavity 26. The layer of insulative material 34 is a mixture of the foam material of the layer of foam material layer 32 and loosefill insulation.

The loosefill insulation is a multiplicity of discrete, individual tufts, cubes, flakes or nodules 38 having physical characteristics that provide for desired insulative properties. The loosefill insulation can be made from glass fibers, although other mineral fibers, organic fibers, and cellulose fibers can be used. As will be discussed in more detail below, the loosefill insulation can be conditioned by a blowing insulation machine configured to distribute the conditioned loosefill insulation into the insulation cavities 26. In the illustrated embodiment, the loosefill insulation is unbonded loosefill insulation. Alternatively, the loosefill insulation can be any desired loosefill insulation.

The layer of insulative material 34, having the mixture of the foam material and the loosefill insulation, can be characterized by several properties including the volumetric ratio of the foam material to the loosefill insulation, the density of the loosefill insulation within the mixture and by the resulting insulative value of the combination of the layer of foam material 32 and the layer of insulative material 34.

In the illustrated embodiment, the volumetric ratio of the foam material to the loosefill insulation is in a range of from about 0.75 to about 1.25 to 1.00. In other embodiments, the volumetric ratio of the foam material to the loosefill insulation can be less than about 0.75 to 1.00 or more than about 1.25 to 1.00.

In the illustrated embodiment, the density of the loosefill insulation within the mixture is in a range of from about 0.5 lbs/ft$^3$ to about 4.0 lbs/ft$^3$. In other embodiments, the density of the loosefill insulation within the mixture can be less than about 0.5 lbs/ft$^3$ or more than about 4.0 lbs/ft$^3$.

Referring again to FIG. 2, the layer of foam material 32 is configured to provide an air sealant layer and provides minimal insulative value to the insulation cavity 26. The layer of insulative material 34 is configured to provide a desired insulative value (R). Factors contributing to the insulative value (R) include the thickness of the layer of insulative material 34 and the density of the loosefill insulation mixed with the foam material of the layer of insulative material 34. As one non-limiting example, a thickness of the layer of insulative material 34 of 5.50 inches and a density of loosefill insulation of 1.3 lbs/ft$^3$ mixed with the foam material of the layer of insulative material 34 yields an insulative value of about 21. Other combinations of the thickness of the layer of insulative material 34 and density of loosefill insulation mixed with the foam material of the layer of insulative material 34 can provide other desired insulative values (R).

The foam material used for the layer of foam material 32 and the layer of insulative material 34 provides several advantages over other foam-based materials. First, in the illustrated embodiment and unlike polyurethane-based foams, the foam material of the layer of foam material 32 and the layer of insulative material 34 is a latex-based foam that does not require a quarantined work area during application. However, it is within the contemplation of the invention that the foam material of the layer of foam material 32 and the layer of insulative material 34 can be non-latex-based materials. Second, after application and a short curing time, the foam material is tack free and has a consistency that maintains flexibility. By maintain flexibility after curing, excess foam material can be manipulated as required to complete the construction. As one example of manipulating the foam material after curing, excess foam material can be simply compressed back into the insulation cavity 26 by covering construction materials 36, thereby eliminating the time, labor and expense of removal of the foam material extending beyond the insulation cavity 26. The construction materials 36 can be any desired materials, including the non-limiting examples of drywall and paneling. The construction materials 36 simply compress the foam material extending from the insulation cavity 26 back into the insulation cavity 26. Third, the low expansion rate of the foam material provides for ready envelopment of the nodules 38 of the loosefill insulation rather than engaging the nodules 38 with such force so as to force the nodules 38 of loosefill insulation from the insulation cavities 26. Fourth, the low expansion rate of the foam material allows the foam material to envelope the nodules 38 without compressing the nodules 38 of loosefill insulation. By not compressing the nodules 38 of loosefill insulation, the nodules retain their insulative value.

While the embodiment illustrated in FIG. 2 shows a generally uniform density of the nodules 38 of the loosefill insulation throughout the foam material of the layer of insulative material 34, in other embodiments, the density of the loosefill insulation can be varied throughout the foam material of the layer of insulative material 34. As one non-limiting example, the density of the loosefill insulation can be greater in locations around cracks, 28*a* and 28*b*, and windows 24 as shown in FIG. 1 and less in other locations of the insulation cavities 26. In still other embodiments, the density of the nodules 38 of the loosefill insulation can be varied any desired number of times within the same insulation cavity 26.

Referring again to FIG. 2, the layer of foam material 32 and the layer of insulative material 34 provide another advantage over other foam-based insulation systems and over cavities filled only with loosefill insulation. The layer of foam material 32 and the layer of insulative material 34 advantageously maintain their position within the insulation cavity 26 without the use of support devices or support materials. The positions of the layer of foam material 32 and the layer of insulative material 34 are maintained even with insulation cavities 26 have vertical or substantially vertical orientations, such as the non-limiting examples of insulation cavities 26 in sidewalls 12 as shown in FIG. 1.

As shown in FIG. 2, the ability of the layer of foam material 32 and the layer of insulative material 34 to maintain their position within the insulation cavity 26 further substantially minimizes sagging of the layer of foam material 32 or the combination of the foam material and the loosefill insulation in the layer of insulative material 34. By substantially minimizing sagging, the insulative value of the insulation system 30 can be maintained at any location.

Figure 3:
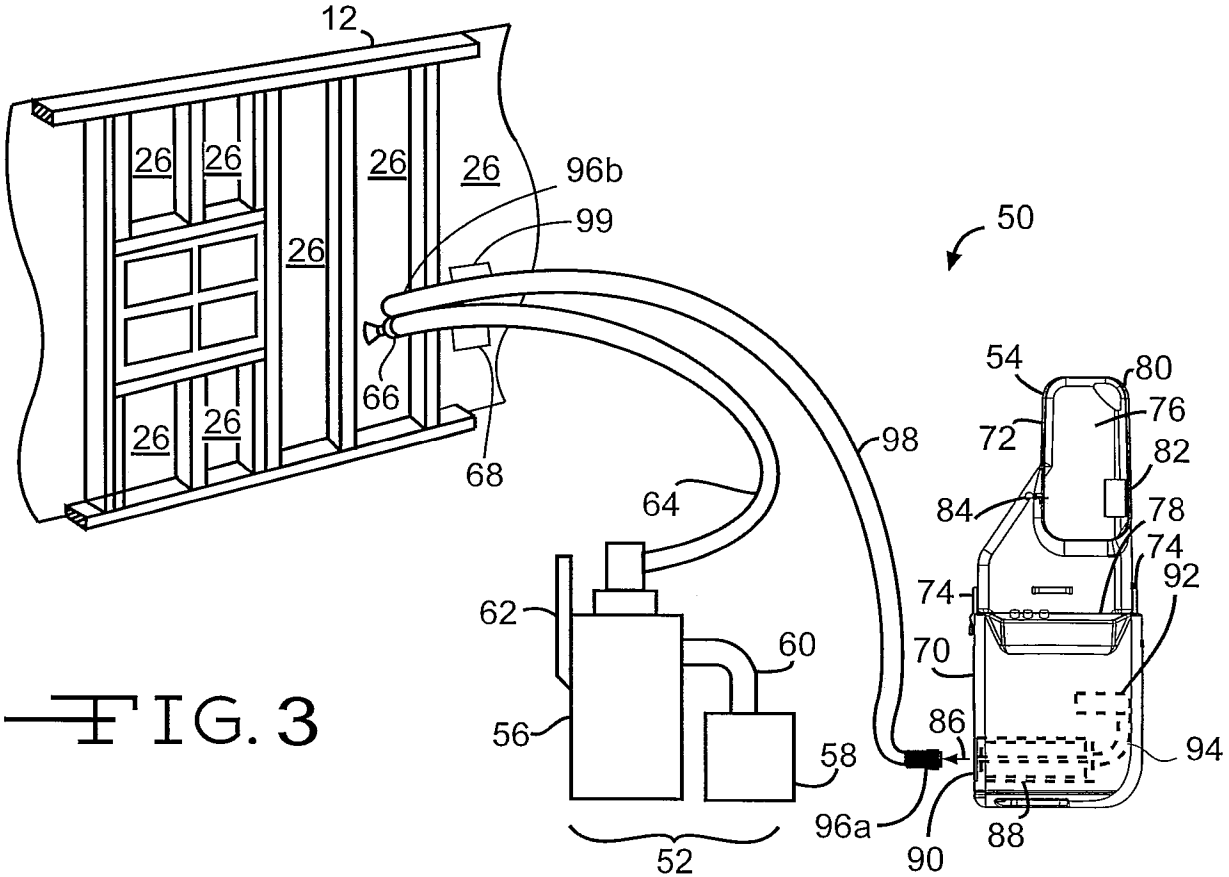
FIG. 3 is a schematic view of a first embodiment of apparatus configured to apply the layer of foam material of FIG. 2 and the layer of insulative material of FIG. 2 into insulation cavities of a building.

Referring now to FIG. 3, apparatus 50 configured for installation of the layer of foam material 32 and the layer of insulative material 34 into the insulation cavities 26 of the sidewall 12 are illustrated. The apparatus 50 include a spray foam device 52 and a blowing insulation machine 54.

Generally, the spray foam device 52 is configured to mix the two components of the foam material forming the layer of foam material 32 and the layer of insulative material 34, and is further configured to convey the mixed foam material to the insulation cavities 26. The spray foam device 52 includes a mixer 56, a plurality of component sources 58 (for purposes of simplicity only one component source 58 is illustrated), a material hose 60, a foam distribution hose 64 and a spray device 66.

The mixer 56 is configured to mix the two components forming the foam material in desired quantities. The mixer 56 can be any desired structure, mechanism or combination thereof sufficient to mix the two components forming the foam material. In one embodiment, the components can be mixed in a ratio of 4 parts of a first component to one part of a second component. In other embodiments, the components of the foam material can be mixed in other desired ratios. In still other embodiments, the foam material can be formed from more than two components. In the illustrated embodiment, the first component is a functionalized acrylic polymer solution and the second component is a cross linker. Alternatively, the various components of the foam material can be other desired materials.

Referring again to FIG. 3, the component source 58 is configured to be a supply of the components of the foam material. In one embodiment, the component source 58 is a bucket or barrel, such as the non-limiting example of 50 gallon drum. In other embodiments, the component source 58 can have other structures, such as the non-limiting example of a supply conduit, sufficient to provide a supply of the component. The components are conveyed from the component source 58 to the mixer 56 via the material hose 60. The material hose 60 can be any desired structure or device, such as the non-limiting example of a hose.

Optionally, the spray foam device 52 can include a control panel 62. The control panel 62 can be configured to include the operating controls (not shown) for the spray foam device 52. In other embodiments, the operating controls for the spray foam device 52 can be positioned in other locations, including remote locations.

After mixing, the foam material exits the spray foam device 52 and is conveyed through the foam distribution hose 64 to the insulation cavity 26. The foam distribution hose 64 can be any desired structure or device, such as the non-limiting example of a hose.

As shown in FIG. 3, the spray device 66 is positioned at an end of the foam distribution hose 64 and configured to spray the foam material into the insulation cavities 26. The spray device 66 can be any desired structure or device, such as the non-limiting example of a spray gun, sufficient to spray the foam material into the insulation cavities 26.

In the illustrated embodiment, an optional operator control device 68 is positioned near the spray device 66. The operator control device 68 is configured to control the operations of the spray foam device 52, such as for example on, off and flow rate. In the illustrated embodiment, the operator control device 68 is configured for wireless communication with the spray foam device 52. However, the operator control device 68 can also be configured for wired communication with the spray foam device 52.

Referring again to FIG. 3, the blowing insulation machine 54 is configured for delivering conditioned loosefill insulation to the spray device 66. The blowing insulation machine 54 includes a lower unit 70 and a chute 72. The lower unit 70 can be connected to the chute 72 by a plurality of fastening mechanisms 74 configured to readily assemble and disassemble the chute 72 to the lower unit 70. The chute 72 has an inlet end 76 and an outlet end 78.

The chute 72 is configured to receive compressed loosefill insulation material from a source of compressed loosefill insulation material and introduce the loosefill insulation material to a plurality of shredding mechanisms (not shown) positioned in the lower unit 70. Optionally, the chute 72 includes a handle segment 80 to facilitate ready movement of the blowing wool machine 54 from one location to another. However, the handle segment 80 is not necessary to the operation of the blowing insulation machine 54.

As further shown in FIG. 3, the chute 72 includes an optional guide assembly 82 mounted at the inlet end 76 of the chute 72. The guide assembly 82 is configured to urge a package of compressed loosefill insulation material against a cutting mechanism 84 as the package moves into the chute 72.

The plurality of shredding mechanisms is mounted at the outlet end 78 of the chute 72. In the illustrated embodiment, the shredding mechanisms include a plurality of low speed shredders and a high speed shredder. The low speed shredders are configured to shred and pick apart the loosefill insulation material as the loosefill insulation material is discharged from the outlet end 78 of the chute 72 into the lower unit 70. The high speed shredder is configured for additional shredding of the loosefill insulation material. While the illustrated embodiment is described as having a plurality of low speed shredders and a high speed shredder, it should be appreciated that any desired quantity and combination of low speed shredders and high speed shredders can be used. It should further be appreciated that any type, quantity and configuration of separator or shredder, such as a clump breaker, beater bar or any other mechanism that shreds and picks apart the loosefill insulation material can be used.

Referring again to FIG. 3, the shredding mechanisms can include shredders (not shown) configured to condition the loosefill insulation material prior to distribution of the loosefill insulation material into an airstream 86. The term "condition" as used herein, is defined as the shredding of the loosefill insulation material to a desired density prior to distribution into the airstream 86. The shredding mechanisms can be positioned within the lower unit 70 in any desired configuration relative to each other.

In the illustrated embodiment, the shredding mechanisms rotate at a speed in a range of from about 40 rpm to about 500 rpm. In other embodiments, the shredding mechanisms can be rotate at speeds less than about 40 or more than about 500 rpm.

Referring again to FIG. 3, a discharge mechanism 88 is positioned in the lower unit 70 downstream from the shredding mechanisms and is configured to distribute the conditioned loosefill insulation material into the airstream 86. In this embodiment, the conditioned loosefill insulation material is driven through the discharge mechanism 88 and through a machine outlet 90 by an airstream provided by a blower 92 mounted in the lower unit 70. In other embodiments, the airstream 86 can be provided by another method, such as by a vacuum, sufficient to provide an airstream 86 driven through the discharge mechanism 88. In the illustrated embodiment, the blower 92 provides the airstream 86 to the discharge mechanism 88 through a duct 94. Alternatively, the airstream 86 can be provided to the discharge mechanism 88 by another structure, such as by a hose or pipe, sufficient to provide the discharge mechanism 88 with the airstream 86.

The shredding mechanisms, discharge mechanism 88 and the blower 92 are mounted for rotation. They can be driven by any suitable means, such as by a motor (not shown), or other means sufficient to drive rotary equipment. Alternatively, the shredding mechanisms, discharge mechanism 88 and the blower 92 can each be provided with its own motor. In the illustrated embodiment, the shredding mechanisms, discharge mechanism 88 and the blower 92 are configured to operate on a single 110 volt, 15 amp power source provided to the blowing insulation machine 54. In other embodiments, the shredding mechanisms, discharge mechanism 88 and the blower 92 can be configured to operate on multiple 110 volt, 15 amp power lines or on a single 220 volt power source.

Referring again to FIG. 3, a first end 96*a* of a loosefill hose 98 is connected to the machine outlet 90 and a second end 96*b* of the loosefill hose 98 is positioned adjacent the spray device 66.

In the illustrated embodiment, an optional blowing insulation controller 99 is positioned near the spray device 66. The blowing insulation controller 99 is configured to control the operations of the blowing insulation machine 54, such as for example on, off and flow rate. In the illustrated embodiment, the blowing insulation controller 99 is configured for wireless communication with the blowing insulation machine 54. However, the blowing insulation controller 99 can also be configured for wired communication with the blowing insulation machine 54.

In operation, the chute 72 guides the loosefill insulation material to the shredding mechanisms positioned in the lower unit 70. The shredding mechanisms shred, pick apart and condition the loosefill insulation material. The conditioned loosefill insulation material exits the shredding mechanisms and enters the discharge mechanism 88 for distribution into the airstream 86 provided by the blower 92. The airstream 86, with the conditioned loosefill insulation material, exits the blowing wool machine 54 at the machine outlet 90 and flows through the loosefill hose 98 toward the insulation cavity 26.

In the illustrated embodiment, the spray foam device 52 and the blowing insulation machine 54 are configured to be positioned in a space that is external to the building 10. However, the spray foam device 52 and the blowing insulation machine 54 can be positioned in other desired locations within the interior of the building 10.

In operation, the insulation cavities 26 are filled with the layer of foam material 32 and the layer of insulative material 34 as described in the following process. First, the spray foam device 52 is supplied with components of the foam material. The mixer 56 mixes the components according to a desired ratio and the foam mixture is conveyed to the spray device 66. Next, the layer of foam material 32 is applied to the insulation cavities 26 such that the layer of foam material 32 has the desired thickness. Next, before the layer of foam material 32 has cured, the layer of insulative material 34 is applied to the insulation cavities 26. In one embodiment, the elapsed time between the completion of the application of the layer of foam material 32 and application of the layer of insulative material 34 is in a range of from about 5 seconds to about 5 minutes. In other embodiments, the elapsed time between completion of the application of the layer of foam material 32 to application of the layer of insulative material 34 can be less than about 5 seconds or more than about 5 minutes.

The layer of insulative material 34 is applied as the foam material is delivered by the spray device 66 at the same time the blowing insulation machine 54 delivers conditioned loosefill insulation material to the insulation cavity 26. The foam material and the conditioned loosefill insulation material mix as the foam material and the conditioned loosefill insulation material enter the insulation cavity 26. The mixture of the foam material and the conditioned loosefill insulation material can be in any desired ratio and any desired density. The layer of insulative material 34 can have any thickness to achieve a desired insulative value (R).

Referring again to FIG. 2, since the application of the layer of insulative material 34 occurs prior to the setting of the layer of foam material 32, the interior surface 33*b* of the layer of foam material 32 and the exterior surface 35*a* of the layer of insulative material 34 mix, thereby forming a transition zone 37. As the layers 32 and 34 cure, the transition zone 37 also cures and provides an area of adhesion between the layer of foam material 32 and the layer of insulative material 34.

Following application of the mixture of the foam material and the conditioned loosefill insulation into the insulation cavity 26, the layer of foam material 32 and the layer of insulative material 34 are allowed to cure. During the curing process, the foam material of the layer of insulative material 34 expands to envelop the entrained nodules 38 of loosefill insulation material and further expands to fill gaps that may occur between the entrained nodules 38. After curing of the layer of insulative material 34, the entrained nodules 38 of loosefill insulation material are suspended within the cured foam material. Optionally, curing of the layer of foam material 32 or the layer of insulative material 34 can be accelerated using any desired methods, such as the non-limiting example of heat. In certain embodiments after curing, the entrained nodules 38 and the filled gaps can result in a structure that advantageously facilitates subsequent removal of the layer of insulative material 34.

While the embodiment illustrated in FIG. 3 shows delivery of conditioned loosefill insulation material to the insulation cavities 26 by a blowing insulation machine, it should be appreciated that other machines can be used to deliver conditioned loosefill insulation material to the insulation cavities 26. One non-limiting example of another blowing insulation machine is a contractor's loosefill blowing machine mounted on a truck. Similarly, the spray foam device 52 can be other desired machines, including the non-limiting example of a conventional insulative foam delivery machine of the type typically used by insulation contractors.

While the apparatus 50, illustrated in FIG. 3 and discussed above, provides separate deliveries of the foam material and the conditioned loosefill insulation material to the insulation cavities 26, in other embodiments the foam material and the conditioned loosefill insulation material can be mixed prior to delivery to the insulation cavities 26.

While the apparatus 50, illustrated in FIG. 3 and discussed above, is configured for installation of both the layer of foam material 32 and the layer of insulative material 34 into the insulation cavities 26 of the sidewall 12, it should be appreciated that in other embodiments, the apparatus 50 can selectively deliver only the layer of foam material 32 or alternatively only the layer of insulative material 34 into the insulation cavities 26 of the sidewall 12.

Figure 4:
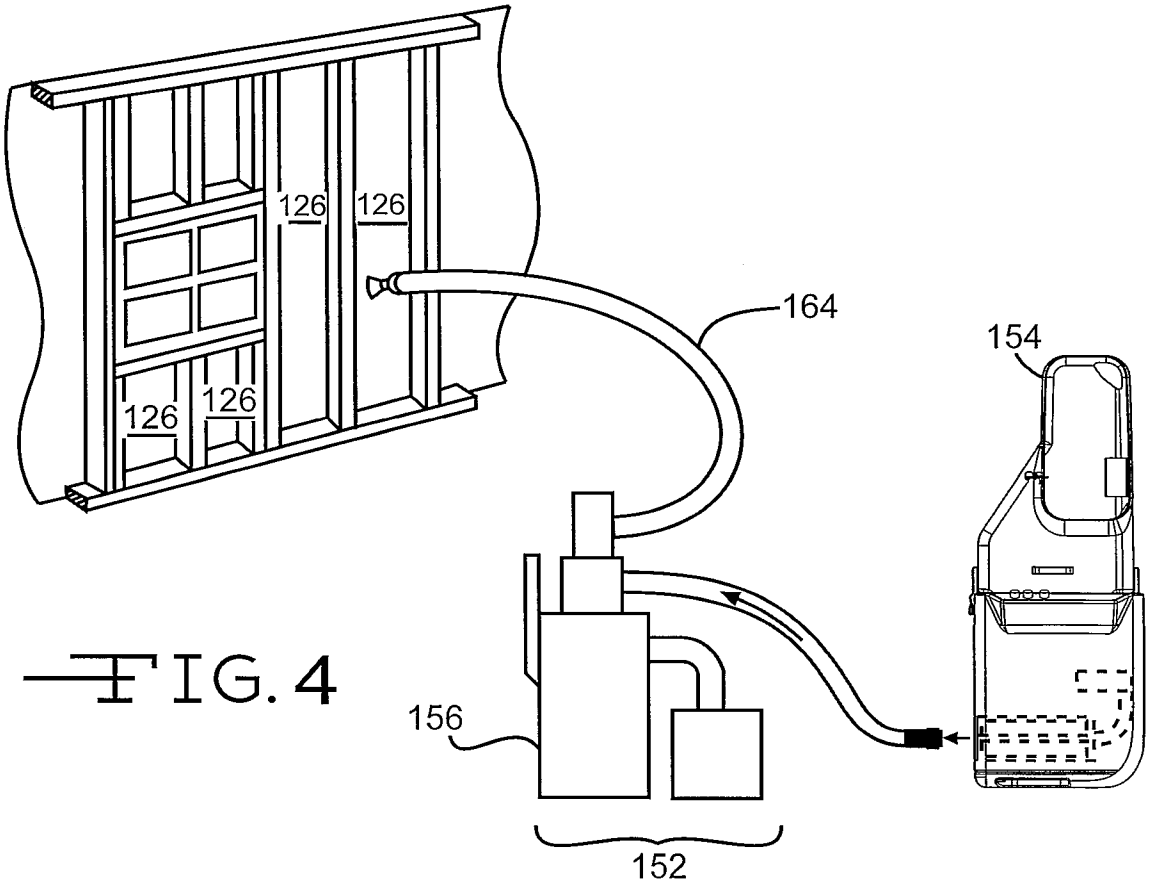
FIG. 4 is a schematic view of a second embodiment of apparatus configured to apply the layer of foam material of FIG. 2 and the layer of insulative material of FIG. 2 into insulation cavities of a building.

Referring now to FIG. 4, a spray foam device 152 and a blowing insulation machine 154 are provided. The spray foam device 152 and the blowing insulation machine 154 are the same as, or similar to the spray foam device 52 and the blowing insulation machine 54 illustrated in FIG. 3 and described above with a few modifications. First, the blowing insulation machine 154 is configured to deliver conditioned loosefill insulation material to the spray foam device 152 in lieu of delivering the conditioned loosefill insulation material to the insulation cavities 126. Second, the spray foam device 152 is configured to mix the foam material with the conditioned loosefill insulation material using a mixer 156. The formed mixture having the foam material and the conditioned loosefill insulation material is then conveyed to the insulation cavities 126 through the distribution hose 164 for application subsequent to the application of the layer of foam material. The applied layer of foam material and the layer of insulative material are allowed to cure as described above. As noted above, other loosefill blowing machines can be used to deliver the loosefill insulation material.

While the spray foam device 152 and the blowing insulation machine 154, illustrated in FIG. 4 and discussed above, are configured for installation of both the layer of foam material 32 and the layer of insulative material 34 into the insulation cavities 26 of the sidewall 12, it should be appreciated that in other embodiments, the spray foam device 152 and the blowing insulation machine 154 can selectively deliver only the layer of foam material 32 or alternatively only the layer of insulative material 34 into the insulation cavities 26 of the sidewall 12.

Figure 5:
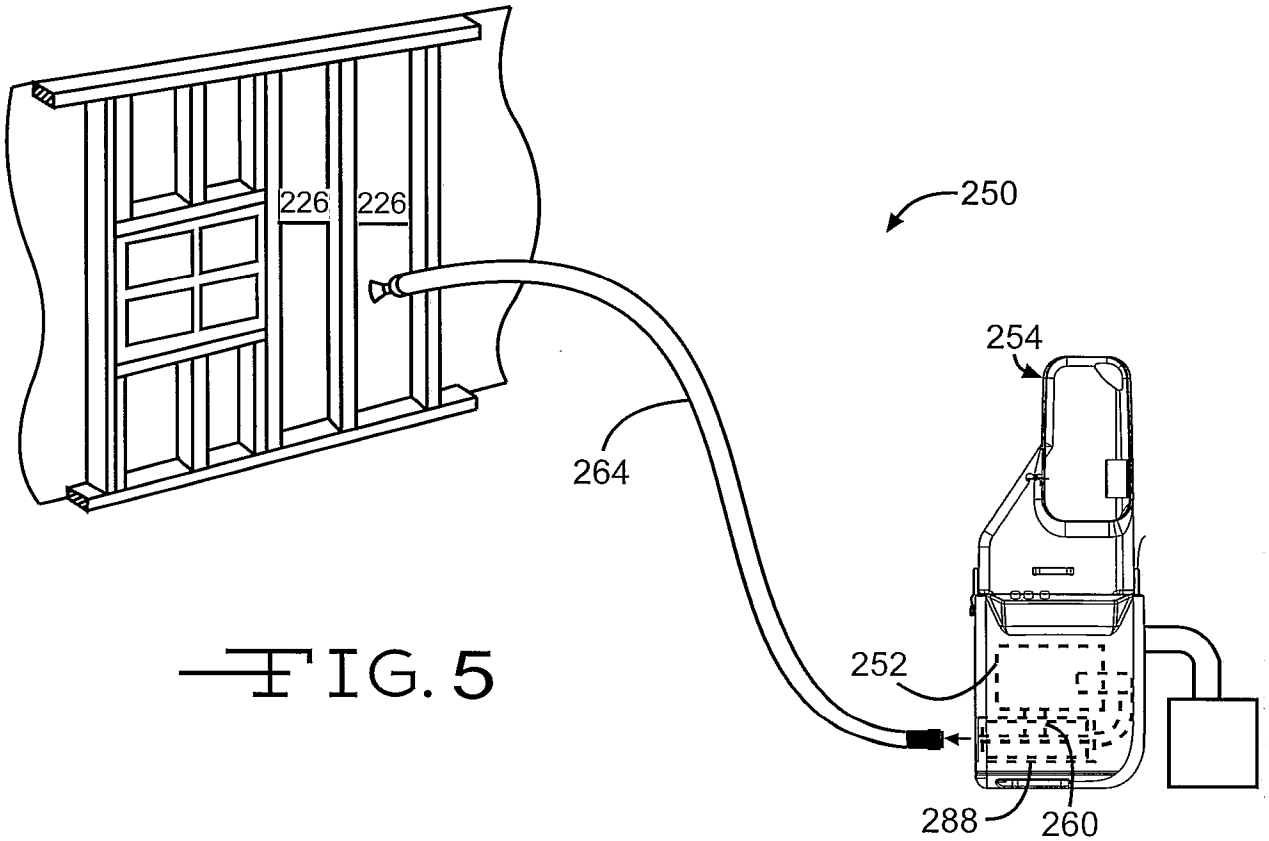
FIG. 5 is a schematic view of third embodiment of apparatus configured to apply the layer of foam material of FIG. 2 and the layer of insulative material of FIG. 2 into insulation cavities of a building.

While the apparatus 50, illustrated in FIG. 3 and discussed above includes separate components for the spray foam device 52 and the blowing insulation machine 54, other embodiments of the apparatus combine the spray foam device 52 and the blowing wool machine 54 into a single apparatus. Referring now to FIG. 5, an apparatus 250, includes both a spray foam device (shown schematically at 252) and a blowing insulation machine 254. The spray foam device 252 and the blowing insulation machine 254 are the same as, or similar to, the spray foam device 52 and the blowing insulation machine 54 illustrated in FIG. 3 and described above.

While the apparatus 250, illustrated in FIG. 5 and discussed above, is configured for installation of both the layer of foam material 32 and the layer of insulative material 34 into the insulation cavities 26 of the sidewall 12, it should be appreciated that in other embodiments, the apparatus 250 can selectively deliver only the layer of foam material 32 or alternatively only the layer of insulative material 34 into the insulation cavities 26 of the sidewall 12.

In the embodiment illustrated in FIG. 5, a connector 260 connects the spray foam device 252 with a discharge mechanism 288. The discharge mechanism 288 is the same as, or similar to, the discharge mechanism 88 illustrated in FIG. 3 and discussed above. The connector 260 is configured to provide passage of a mixed foam material to the discharge mechanism 288. The discharge mechanism 288 is configured to mix the foam material with conditioned loosefill insulation material. The formed mixture having the foam material and the conditioned loosefill insulation material is then conveyed to insulation cavities 226 through distribution hose 264 for application subsequent to the application of the layer of foam material. The applied layer of foam material and the layer of insulative material are allowed to cure as described above.

While the embodiment illustrated in FIG. 5 illustrates a spray foam device 252 incorporated into a blowing insulation machine 254, it is within the contemplation of this invention that in other embodiments a blowing insulation machine can be incorporated into a spray foam device.

The principle and mode of operation of the apparatus and methods for application of foam and foam/loosefill insulation systems into insulation cavities of a building have been described in certain embodiments. However, it should be noted that the apparatus and methods for application of foam and foam/loosefill insulation systems into insulation cavities of a building may be practiced otherwise than as specifically illustrated and described without departing from its scope.

What is claimed is:

1. An insulated cavity comprising:

adjacent framing members having opposing interior surfaces;

construction material attached to the adjacent framing members, the construction material having an interior surface, wherein the interior surfaces of the adjacent framing members and the interior surfaces of the construction material define an insulation cavity;

a layer of foam material limited to the interior surfaces of the adjacent framing members and the interior surfaces of the construction material, the layer of foam material further positioned over cracks and around penetrations occurring in portions of the insulation cavity, the layer of foam material having a thickness, the layer of foam material including a cross linker;

a layer of insulative material positioned in contact with the layer of foam material, the layer of insulative material including a cross linker; and a transition layer bonding the layer of foam material with the layer of insulative material, the transition layer is formed by the mixture of an uncured portion of the layer of foam material, including the cross linker, and an uncured portion of the layer of insulative material, including the cross linker;

wherein the layer of insulative material is a mixture of foam material and loosefill insulation material, the loosefill insulation material including a multiplicity of discrete, individual tufts, cubes, flakes or nodules, and wherein the foam material is configured such that the thickness of the layer of foam material is substantially maintained after the foam material cures.

2. The insulated cavity of claim 1, wherein the cavity is a wall cavity.

3. The insulated wall cavity of claim 1, wherein the layer of insulative material is configured to fill a remaining portion of the cavity.

4. The insulated cavity of claim 1, wherein the loosefill insulation material is unbonded loosefill insulation.

5. The insulated cavity of claim 1, wherein the layer of foam material is a non-allergenic, latex-based, low expanding material configured to maintain its flexibility after it cures.

6. The insulated cavity of claim 1, wherein the layer of foam material has a pressure build of less than 0.1 psi as measured by test method AAMA 812.

7. The insulated cavity of claim 1, wherein the layer of foam material has a thickness in a range of from about 0.10 inches to about 0.50 inches.

8. The insulated cavity of claim 1, wherein the foam material of the layer of foam material and the layer of insulative material are the same foam material.

9. The insulated cavity of claim 1, wherein the layer of insulative material maintains flexibility after curing.

10. The insulated cavity of claim 1, wherein the transition layer bonding the layer of foam material with the layer of insulative material is crosslinked with the layer of foam material and the layer of insulative material.

11. The insulated cavity of claim 1, wherein a density of the loosefill insulation in the foam material of the transition layer is lower than a density of the loosefill insulation in the foam material of the layer of insulative material.

12. An insulated cavity comprising:

adjacent framing members having opposing interior surfaces;

construction material attached to the adjacent framing members, the construction material having an interior surface, wherein the interior surfaces of the adjacent framing members and the interior surfaces of the construction material define an insulation cavity;

a layer of foam material limited to the interior surfaces of the adjacent framing members and the interior surfaces of the construction material, the layer of foam material further positioned over cracks and around penetrations occurring in portions of the insulation cavity, the layer of foam material including a cross linker;

a layer of insulative material positioned in contact with the layer of foam material, the layer of insulative material including a cross linker; and a transition layer bonding the layer of foam material with the layer of insulative material, the transition layer is formed by the mixture of an uncured portion of the layer of foam material, including the cross linker, and an uncured portion of the layer of insulative material, including the cross linker;

wherein the layer of insulative material is a mixture of foam material and loosefill insulation material, the loosefill insulation material including a multiplicity of discrete, individual tufts, cubes, flakes or nodules;

wherein the foam material forming the layer of foam material and the layer of insulative material is configured to maintain flexibility after curing such that excess foam material can be manipulated as required to complete construction.

13. The insulated cavity of claim 12, wherein the transition layer bonding the layer of foam material with the layer of insulative material is crosslinked with the layer of foam material and the layer of insulative material.

14. The insulated cavity of claim 12, wherein a density of the loosefill insulation in the foam material of the transition layer is lower than a density of the loosefill insulation in the foam material of the layer of insulative material.

15. A method of insulating a cavity within a building, the method comprising the steps of:

applying a layer of foam material into the cavity, the layer of foam material including a cross linker;

applying a layer of insulative material into the cavity, the layer of insulative material being positioned in contact with the layer of foam material, the layer of insulative material being a mixture of foam material and loosefill insulation material and including a cross linker, the layer of insulative material applied before the layer of foam material cures, the loosefill insulation material including a multiplicity of discrete, individual tufts, cubes, flakes or nodules;

allowing the layer of foam material and the layer of insulative material to cure, wherein a transition layer is formed by a mixture of an uncured portion of the layer of foam material, including the cross linker, and an uncured portion of the layer of insulative material, including the cross linker, prior to the step of allowing the layer of foam material and the layer of insulative material to cure, the transition layer bonding the layer of foam material with the layer of insulative material after the step of allowing the layer of foam material and the layer of insulated material to cure.

16. The method of claim 15, including the step of positioning the layer of foam material over cracks and around penetrations occurring in portions of the cavity.

17. The method of claim 15, wherein the layer of foam material and the layer of insulative material include a non-allergenic, latex-based, low expanding material configured to maintain its flexibility after it cures.

18. The method of claim 15, wherein the foam material of the layer of foam material and the layer of insulative material are the same foam material.

19. The method of claim 15, wherein the transition layer bonding the layer of foam material with the layer of insulative material is crosslinked with the layer of foam material and the layer of insulative material.

20. The method of claim 15, wherein a density of the loosefill insulation in the foam material of the transition layer is lower than a density of the loosefill insulation in the foam material of the layer of insulative material.

* * * * *